US005596861A

United States Patent [19]

Preston et al.

[11] Patent Number: 5,596,861

[45] Date of Patent: Jan. 28, 1997

[54] SYSTEM AND METHOD FOR ESTABLISHING AN ABSOLUTE REFERENCE POINT FOR AN ENVELOPE INSERTER CYCLE

[76] Inventors: Charles E. Preston, 9445 Central Ave., Orangevale, Calif. 95662; Marc J. Fagan, 2786 Brentwood Pl., Davis, Calif. 95616

[21] Appl. No.: 547,240

[22] Filed: Oct. 24, 1995

[51] Int. Cl.[6] ..... B65B 57/00

[52] U.S. Cl. ..... 53/52; 53/284.3; 493/34

[58] Field of Search ..... 53/51, 52, 284.3, 53/569; 493/10, 30, 34; 414/797.8, 797.9; 74/815, 813 C, 813 R; 73/1 E; 33/1 N, 1 PT

[56] References Cited

U.S. PATENT DOCUMENTS

| | | | |
|---|---|---|---|
| 3,589,709 | 6/1971 | Hey et al. | 493/10 |
| 4,054,283 | 10/1977 | Rayfield | 493/10 |
| 4,095,511 | 6/1978 | Woolston | 493/34 |
| 4,391,079 | 6/1983 | Cherney | 493/30 |
| 4,432,745 | 2/1984 | Eldridge | 493/10 |
| 4,604,083 | 8/1986 | Barney et al. | 493/34 |
| 4,604,849 | 8/1986 | Zemke et al. | 53/284.3 |
| 5,123,887 | 6/1992 | Shimura | 493/30 |
| 5,283,754 | 2/1994 | Stieler et al. | 73/1 E |
| 5,301,114 | 4/1994 | Mitchell | 73/1 E |
| 5,435,067 | 7/1995 | Uchida et al. | 33/1 PT |

*Primary Examiner*—James F. Coan
*Assistant Examiner*—John Paradiso
*Attorney, Agent, or Firm*—James M. Ritchey

[57] ABSTRACT

For use on a cyclically operating envelope inserter having a rotating member and a reciprocating member linked to the rotating member, a system for establishing an absolute reference point for timing a cycle of the apparatus that comprises an encoder for ascertaining rotational angle values for the rotating member linked to a detector for establishing for the reciprocating member a first reference point and a second reference point as the reciprocating member moves, wherein the first and second reference points are in terms of the ascertained rotational angle values. Additionally, a controller is provided that is responsive to the detector and encoder for determining from the first and the second reference points a rotational position for the absolute reference point.

11 Claims, 4 Drawing Sheets

SYSTEM AND METHOD FOR ESTABLISHING AN ABSOLUTE REFERENCE POINT FOR AN ENVELOPE INSERTER CYCLE

BACKGROUND OF THE INVENTION

1. Field of the Invention

Disclosed are a system and a method for establishing an absolute reference point for a cycle of a cyclically operating apparatus. More specifically, a system and method are provided for establishing an absolute reference point for a cycle of an envelope inserter in which periodic reciprocating motion of a rotating member-linked structural component of the inserter is utilized in the generation of the absolute reference point.

2. Description of the Background Art

An envelope inserter functions to place various inserts like billing statements, advertisements, coupons, return envelopes, and the like within a sending or mailing envelope. Traditionally, a shaft encoder is employed in association with a motor, a drive shaft, a timing shaft, or other rotating component on the envelope inserter to determine rotational positions for the rotating member associated with the encoder and thus, positional references for rotating member-linked components and processes during an envelope insertion cycle such as when to open a mailing envelope, when to pick an insert, when to fill a mailing envelope, when to wet and seal a mailing envelope, and the like. For precise positional references, a system and method are needed to calibrate or correlate a home position that indicates where the shaft encoder signals the zero reference point (ideally the starting position of an insert cycle) and an actual physical location on the motor shaft, drive shaft, timing shaft, or other rotating member. If the actual physical location on the rotating member for a particular process differs from where the encoder indicates the rotating member is located then the various processing steps may become disorganized and interrupt or jam the machine.

In the past, the standard home position or zero reference point calibration process entailed a technician manually aligning the timing shaft or other rotating member to a proscribed standard physical location and physically rotating the encoder zero position to correspond to that location, which resulted in about a ±5–10% reproducibility error. The correct encoder zero position was determined either by a visual and not very reproducible observation or it was determined, more precisely, by noting where a LED coupled into a control unit which received the encoder signal would light each time the home position was reached.

A difficulty with the traditional manual approach to determining the home position or zero reference point was that the physical alignment of the timing shaft or other rotating member often differed from one technician to another technician. A first technician might physically align one particular component of the inserter as zero and a second technician might select a different component to align or align the same component in a slightly different fashion, thereby introducing small, but significant inconsistencies in the process. The subject invention overcomes the irreproducibility inherent in the traditional zero reference point determining process by utilizing an index pulse that gives an "absolute" positional value that is not subject to the vagaries of individual alignment techniques. Preferably, the index pulse issues from the controller when the reciprocating component reaches the inner limit.

The foregoing information reflects the state of the art of which the applicant is aware and is tendered with the view toward discharging applicant's acknowledged duty of candor in disclosing information which may be pertinent in the examination of this application. It is respectfully submitted, however, that this information does not teach or render obvious applicant's claimed invention.

SUMMARY OF THE INVENTION

An object of the present invention is to provide an envelope inserter system for determining an absolute reference point for an inserter cycle which in turn is utilized to synchronize various components.

Another object of the present invention is to disclose an envelope inserter system for generating a timing pulse that indicates where an absolute reference point occurs in a cycle for the inserter.

A further object of the present invention is to furnish a method for synchronizing an envelope inserter by determining an absolute reference point and issuing a timing pulse to indicate when the absolute reference point is reached during a cycle of the inserter.

Still another object of the present invention is to relate a method for synchronizing an envelope inserter by determining an absolute reference point via a computer actuated calculation that utilizes first and second reference points established from the motion of a reciprocating member that is linked to a cyclically rotating member in the inserter.

Disclosed for use on a cyclically operating envelope inserter having a rotating member (usually a motor shaft, drive shaft, or timing shaft) and a reciprocating member (usually a rocking or pivoting arm associated with selecting or picking inserts) linked to the rotating member, is a system for establishing an absolute reference point for timing a cycle of the envelope inserter. The subject invention comprises encoder means for ascertaining rotational angle values for the rotating member, detection means for establishing for the reciprocating member a first reference point as the reciprocating member moves in a first direction to a first limit and a second reference point as the reciprocating member moves in a second direction to a second limit (the motion is generally a rocking or pivoting motion that extends between two reversal extremes). Included is a controller means, usually a computer, responsive to the detection and encoder means. The controller means has programming that determines from the first and the second reference points a rotational position for the absolute reference point. The programming establishes the absolute reference point value from information sent by the shaft encoder for rotational angle values for the first and the second reference points and an appropriate formula that averages an absolute difference between the rotational angle values for the first and the second reference points and adds a resultant angle to whichever of the rotational angle values for the first and the second reference points is smaller. Once the angular value for the absolute reference point is calculated, the controller also has means for generating and issuing a pulse that indicates when the absolute reference point is reached.

Depending of the direction of travel by the reciprocating member, for a first direction the first reference point for the subject system is produced by the detection means when the reciprocating member is exiting the detection means and the second reference point is produced by the detection means when the reciprocating member is entering the detection means or for the opposite direction the first reference point is produced by the detection means when the reciprocation member is entering the detection means and the second reference point is produced by the detection means when the reciprocating member is exiting the detection means.

Usually, the detection means comprises a photoemitter and a photodetector secured to the apparatus and positioned for the reciprocating member to pass between the photoemitter and the photodetector. Thus, when the detection means comprises a photoemitter and photodetector the first reference point is produced by the detection means when the reciprocating member exits from between the photoemitter and the photodetector thereby allowing light to pass between the photoemitter and the photodetector and the second reference point is produced by the detection means when the reciprocating member enters between the photoemitter and the photodetector thereby interrupting the light passing between the photoemitter and the photodetector or the first reference point is produced by the detection means when the reciprocation member enters between the photoemitter and the photodetector thereby interrupting the light passing between the photoemitter and the photodetector and the second reference point is produced by the detection means when the reciprocating member exits from between the photoemitter and the photodetector thereby allowing light to pass between the photoemitter and the photodetector.

Utilizing the subject system, a method for establishing an absolute reference point for timing a cycle of the envelope inserter comprises establishing for the reciprocating member via the detection means a first reference point as the reciprocating member moves in a first direction to a first limit and a second reference point as the reciprocating member moves in a second direction to a second limit. The subject method includes producing by use of the encoder means a first rotational angle value for the first reference point and a second rotational angle value for the second reference points. Additionally, the method comprises determining from the first and the second rotational angle values for the first and the second reference points a rotational position for the absolute reference point. The determination comprises averaging an absolute difference between the first and the second rotational angle values for the first and the second reference points and adding a resultant angle to whichever of the first and the second rotational angle values for the first and the second reference points is smaller to produce a rotational value for the absolute reference point. Also, the method encompasses generating a pulse that indicates when the determined absolute reference point is reached.

Usually, the first reference point is produced by the detection means when the reciprocating member is exiting the detection means and the second reference point is produced by the detection means when the reciprocating member is entering the detection means or the first reference point is produced by the detection means when the reciprocation member is entering the detection means and the second reference point is produced by the detection means when the reciprocating member is exiting the detection means. More specifically, when the detection means comprises a photoemitter and a photodetector secured to the apparatus and positioned for the reciprocating member to pass between the photoemitter and the photodetector, the first reference point is produced by the detection means when the reciprocating member exits from between the photoemitter and the photodetector and the second reference point is produced by the detection means when the reciprocating member enters between the photoemitter and the photodetector or the first reference point is produced by the detection means when the reciprocation member enters between the photoemitter and the photodetector and the second reference point is produced by the detection means when the reciprocating member exits from between the photoemitter and the photodetector.

Other objects, advantages, and novel features of the present invention will become apparent from the detailed description that follows, when considered in conjunction with the associated drawings.

DESCRIPTION OF THE PREFERRED EMBODIMENT

The subject system and method may be utilized with any machine that includes at least one component that periodically reciprocates between first and second limiting positions as an encoder coupled rotating member rotates through 360° for a cycle. For exemplary purposes only and not by way of limitation, the subject system and method will be described in terms of usage with an cyclically operating envelope inserter of the type traditionally termed a "PHILLIPSBURG" from Bell and Howell's Phillipsburg Division and modifications thereof.

In a PHILLIPSBURG type inserter motor is linked to a central drive shaft which is coupled to a rotating timing shaft and several components that periodically reciprocate between limiting positions at which the direction of travel reverses. A standard shaft encoder is coupled to a rotating member such a motor, timing shaft, drive shaft, and the like for recording rotational positions of the rotating member from 0° to 360°. The reciprocating components within an inserter are numerous and include; a drive-gripper arm shaft, an arm assembly gripper or insert picker arm, and several other parts. For ease of access and reproducibility on the PHILLIPSBURG, the drive-gripper arm shaft was selected to be utilized as the reciprocating member in the subject invention, however, most, if not all, of the other reciprocating components would be acceptable in implementing the subject system and process. The drive-gripper arm shaft also has the benefit that, unlike the arm assembly gripper, it is not usually adjusted during normal use of the PHILLIPSBURG and thus stays at a generally constant position over long term usage of the inserter.

Figure 1:
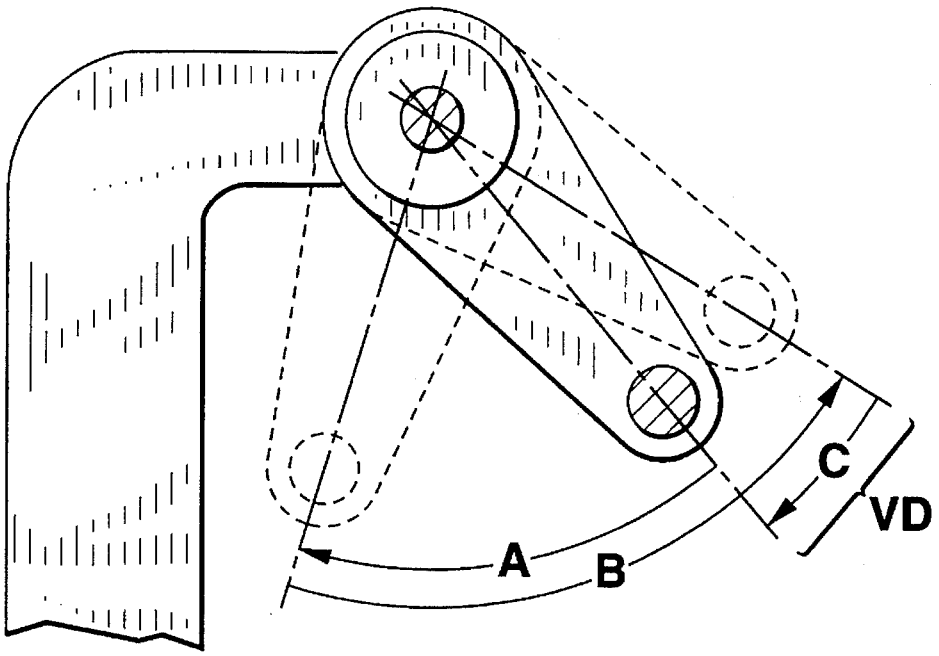
FIG. – 1 PRIOR ART
FIG. 1 is a diagram of the prior art relating the reciprocating motion found in several components of an envelope inserter.

As seen in FIG. 1 for the existing state of the art, the periodic reciprocation of a component is generally a swinging or rocking motion (generally about a center of rotation or axis at a shaft that turns back and forth) that extends between two extremes comprising a first or inner limit and a second or outer limit. Usually, during one cycle of the inserter a mailing envelope is selected, opened, filled with inserts, wetted, closed, sealed, and directed for further processing. Also, one cycle of the inserter generally encompasses each of the reciprocating components moving from a starting position to the first limit, then reciprocating back to the second limit, then returning to the original starting position, as indicated by the arrows in FIG. 1. Ideally, the starting position for a typical insert cycle is the home position or zero reference point, but an insert cycle could start at other locations. Usually, the home position is not exactly at either the first or second limit positions for reciprocation, but offset between the two limits (usually closer to the second or outer limit as shown in FIG. 1) a variable number of rotational degrees VD, as established by the shaft encoder on the rotating member, usually the timing shaft or motor. Often the rotational degrees VD for the home position is approximately 45° to 55° in from the second or outer limit.

Figure 2:
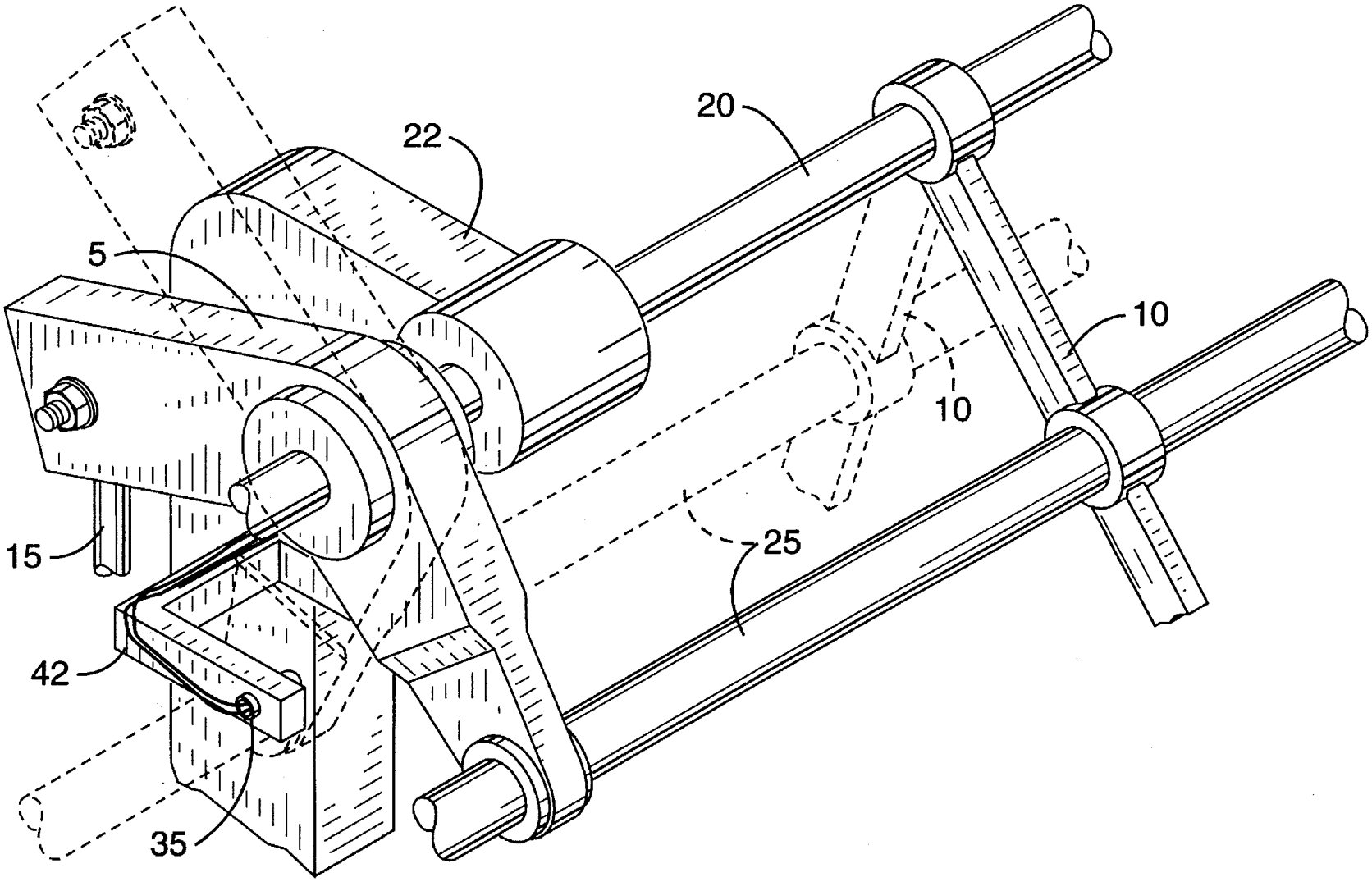
FIG. 2 is a perspective view of a portion of an envelope inserter showing detector means and reciprocating members with the reciprocating means moving to a second position in dashed lines.
Figure 3:
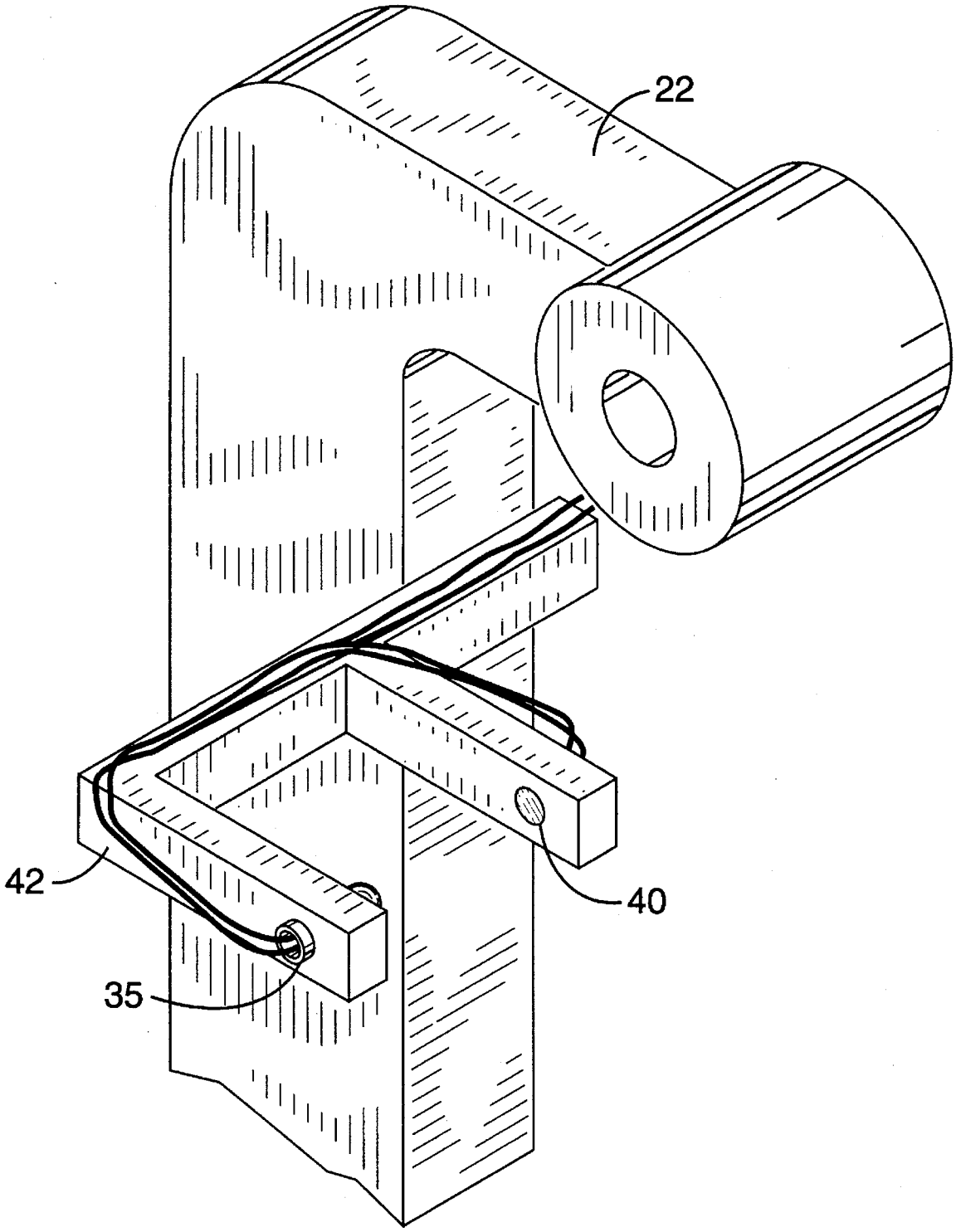
FIG. 3 is a perspective view of the detector means of the subject invention.

Referring now to FIGS. 2–5, there is shown a preferred embodiment of a system for establishing a zero reference point on a rotating member fitted with an encoder. In the envelope inserter there are various components that rock or pivot back and forth or reciprocate from a first maximum deflection or limit to a second maximum deflection or limit (also, as indicated in FIG. 1). Two such reciprocating members are illustrated in FIG. 2 as a gripper arm shaft drive 5 and a gripper arm shaft assembly 10. A drive lever 15 links the gripper arm shaft 20 to the drive motor (not shown). The gripper arm shaft 20 is attached to the remainder of the inserter by a support 22. Further connecting the gripper arm shaft 20 to a gripper arm operating shaft 25 is the gripper arm shaft drive 5, noted above. As the drive motor rotates to power the inserter the inserts are selected or picked by the gripper arm shaft assembly 10, specifically within the insert gripper jaws (not shown), reciprocating between its outer limit (drawn in solid lines in FIG. 2) and the inner limit (drawn in dashed lines in FIG. 2). Likewise, the gripper arm shaft drive 5 reciprocates between its outer limit (drawn in solid lines in FIG. 2) and the inner limit (drawn in dashed lines in FIG. 2).

To detect when a reciprocating member passes a given point in the outer limit to inner limit swing, a detection means is included in the subject invention. Although the detection means can be positioned to detect reciprocating motion for any of the reciprocating members, preferably the detection means is located proximate the gripper arm shaft drive 5. The preferred location is easily accessed and the gripper arm shaft drive 5 is not usually moved or adjusted during normal operation of the inserter. The detection means may comprise any standard device, however, preferred for the detection means is a paired set of a photoemitter 35 and a photodetector 40 (the exact orientation could be reversed from that shown) held in a suitable bracket 42 (see FIG. 3 for details).

For the paired photoemitter 35 and photodetector 40 as the gripper arm shaft drive 5 comes between the halves of the detector the signal communicated between them is broken and the interrupt is communicated to an interfaced controller means or computer (see below for more details about the controller). As the gripper arm shaft drive 5 swings between the two halves of the detector towards its inner limit it does not allow the signal between the two halves to be reestablished until it has reached the inner limit of motion and is traveling or reciprocating back towards the outer limit of reciprocation. Once the gripper arm shaft drive 5 in its swing towards the outer limit passes from between the two halves of the sensor the signal is reestablished and communicated to the controller. The "make-break" sequence for the detector signal occurs only once during any one cycle of the inserter, regardless of where the gripper arm shaft drive 5 has previously stopped in a cycle. It should be noted that for any machine cycle the inserter only progresses in a linear fashion since envelopes are only filled and not somehow emptied. Sometimes the gripper arm shaft drive 5 may start already within a full cycle, having previously stopped short of completing a full cycle, and be within the two detector halves or it may have stopped outside the detector gap. When the gripper arm shaft drive 5 begins to move in a cycle, depending upon where it stopped previously, the controller may first be sent an interrupt then a made signal or the controller may first be sent a made signal and then an interrupt. In either case, from only one cycle a first reference point and a second reference point are generated from the make-break sequence.

Figure 4:
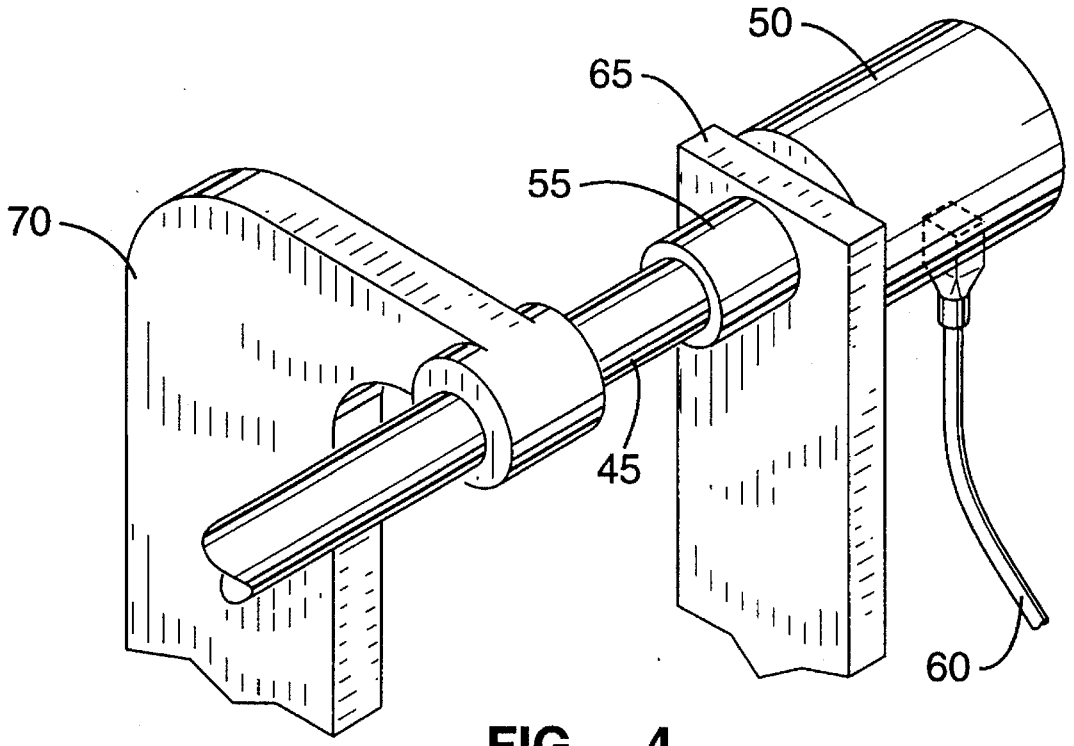
FIG. 4 is perspective view of a shaft encoder associated with a timing shaft in an envelope inserter.

For ascertaining rotational angles of a rotating member within the envelope inserter encoder means is utilized. Numerous rotating members exist within the typical inserter including the drive motor, drive shaft, timing shaft, and the like. Usually a standard shaft encoder is employed that detects rotational position values between 0° and 360° for any associated rotating member and this angular notation is transmitted through appropriate interfacing to a receiving controller means. By way of example only and as seen in FIG. 4, the timing shaft 45 will be used to illustrate the subject system in conjunction with the shaft encoder 50 via a coupler 55 and a controller interfacing connection or wire 60. Mounting brackets 65 and 70 (70 is usually part of the inserter shaft 45 support) hold the encoder 50 to the inserter structure.

Therefore, the subject system for establishing an absolute reference point for timing a cycle of the apparatus comprises encoder means for ascertaining rotational angle values for the rotating member and detection means for establishing for the reciprocating member a first reference point and a second reference point as the reciprocating member moves, wherein the first and second reference points are in terms of the encoder means ascertained rotational angle values. Controller means responsive to the detection and encoder means is provided for determining from the first and the second reference points a rotational position for the absolute reference point.

Specifically, the first reference point is produced by the detection means when the reciprocating member is exiting the detection means and the second reference point is produced by the detection means when the reciprocating member is entering the detection means or the first reference point is produced by the detection means when the reciprocation member is entering the detection means and the second reference point is produced by the detection means when the reciprocating member is exiting the detection means. More specifically, the first reference point is produced by the detection means when the reciprocating member exits from between the photoemitter and the photodetector and the second reference point is produced by the detection means when the reciprocating member enters between the photoemitter and the photodetector or the first reference point is produced by the detection means when the reciprocation member enters between the photoemitter and the photodetector and the second reference point is produced by the detection means when the reciprocating member exits from between the photoemitter and the photodetector.

Figure 5:
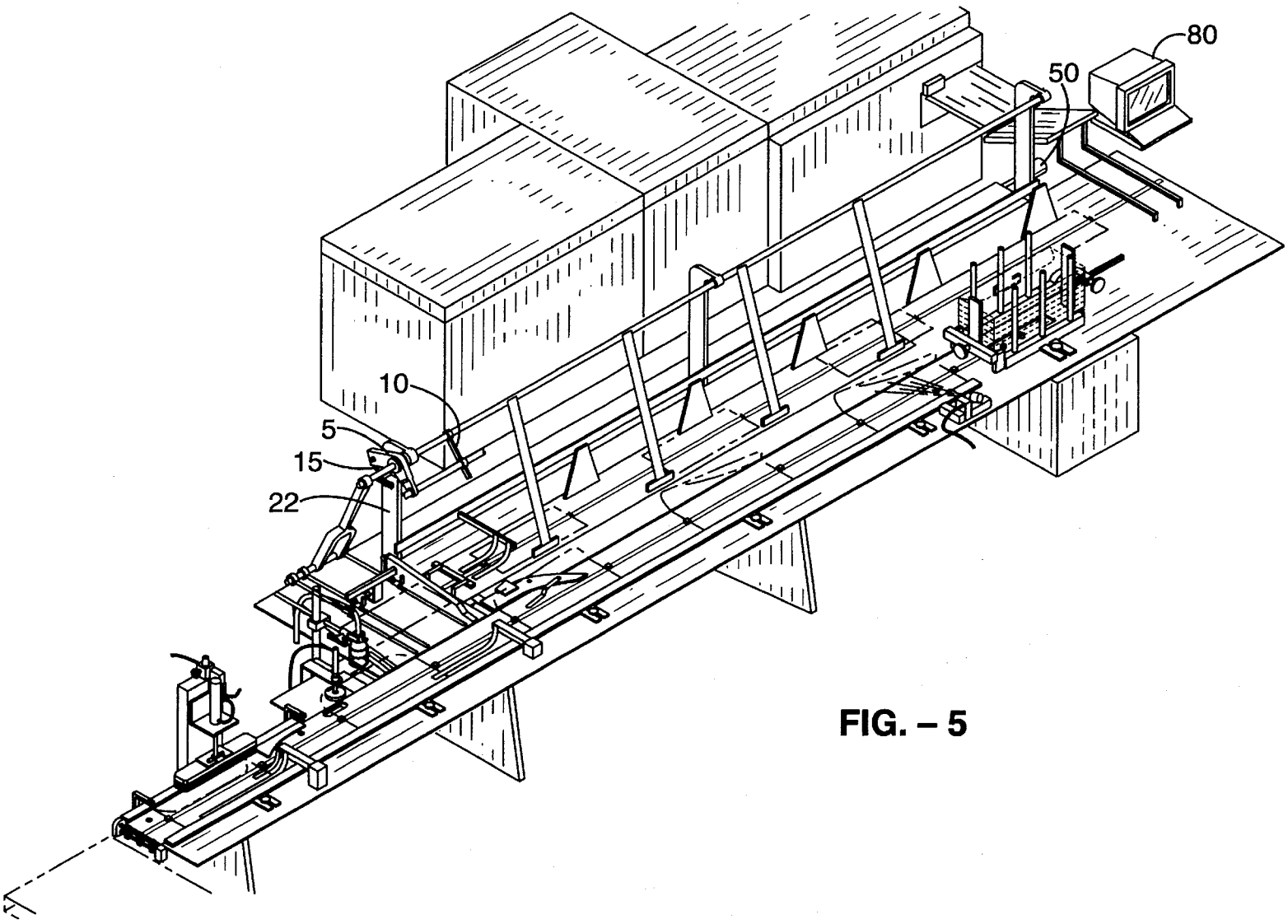
FIG. 5 is a perspective view of the envelope inserter utilized in the subject invention.

Controller means or usually a computer 80 is included in the subject invention and is depicted in the overall view of the inserter seen in FIG. 5, as are the shaft encoder 50 and reciprocating members. The computer 80 is usually a PC type computer and is generally interfaced with a central overseeing and usually more sophisticated computer having extensive data sources for the items being mailed. The controller has programming designed to establish by means of the shaft encoder the rotational angle values for the first and the second reference points. Further, the computer 80 has programming for averaging an absolute difference between the rotational angle values for the first and the second reference points and adding a resultant angle to whichever of the rotational angle values for the first and the second reference points is smaller to produce a rotational value for the absolute reference point.

By way of example and not by way of limitation, if the detector interrupt rotational position, as determined by the encoder, is at 202° and the re-establishment of the signal is at 160° (when the gripper arm shaft drive 5 is initially not blocking the detector's signal), then the computer calculates via the formula:

$$((202°-160°)/2)+160°=181°$$

that the absolute reference point and the position at which the absolute reference point pulse signal should be sent is at 181° for synchronizing the various operations of the inserter to a constant calibration or reference standard. Additionally, when the gripper arm shaft drive 5 is initially blocking the detector's signal and the re-establishment of the signal is at 202° and the interrupt of the signal is at 160°, then the computer calculates via the formula:

$$((202°-160°)/2)+160°=181°$$

that the absolute reference point and the position at which the absolute reference point pulse signal should be sent is once again at 181°. In either case, the absolute reference point is determined during only one cycle of the inserter.

Typically, the method of utilizing the subject system comprises establishing for the reciprocating member via the detection means the first reference point as the reciprocating member moves in the first direction to the first limit and the second reference point as the reciprocating member moves in the second direction to the second limit. Further, the method produces by use of the encoder means for ascertaining rotational angle values for the rotating member the first rotational angle value for the first reference point and the second rotational angle value for the second reference points. The controller means then determines from the first and the second rotational angle values for the first and the second reference points the rotational position for the absolute reference point.

The invention has now been explained with reference to specific embodiments. Other embodiments will be suggested to those of ordinary skill in the appropriate art upon review of the present specification.

Although the foregoing invention has been described in some detail by way of illustration and example for purposes of clarity of understanding, it will be obvious that certain changes and modifications may be practiced within the scope of the appended claims.

What is claimed is:

1. For use on a cyclically operating apparatus having a rotating shaft and a reciprocating member linked to the rotating shaft, a system for establishing an absolute reference point for timing a cycle of the apparatus, comprising:

a) a shaft encoder that reports a rotational angle value for the rotating shaft;

b) a detector mounted to sense passing of the reciprocating member for initiating a signal to a controller for establishing for the reciprocating member a first reference point as the reciprocating member moves in a first direction to a first limit and a second reference point as the reciprocating member moves in a second direction to a second limit, wherein if said reciprocating member is initially within said detector said first reference point is signaled by said detector when said reciprocating member is exiting said detector and said second reference point is signaled by said detector when said reciprocating member is entering said detector or if said reciprocating member is initially not within said detector said first reference point is signaled by said detector when said reciprocation member is entering said detector and said second reference point is signaled by said detector when said reciprocating member is exiting said detector and said first and said second reference points are each in terms of a rotational angle value reported from said shaft encoder;

c) said controller responsive to said detector and said shaft encoder for determining from said first and said second reference points a rotational angle value position for the absolute reference point, wherein said determination by said controller comprises:

establishing by means of said shaft encoder said rotational angle values for said first and said second reference points and averaging a difference between said rotational angle values for said first and said second reference points and adding a resultant angle to whichever of said rotational angle values for said first and said second reference points is smaller to produce said rotational angle value for the absolute reference point.

2. A system for establishing an absolute reference point according to claim 1, wherein said controller means further comprises means for generating a pulse that indicates when the absolute reference point is reached.

3. A system for establishing an absolute reference point according to claim 1, wherein said detection means comprises a photoemitter and a photodetector secured to the apparatus and positioned for the reciprocating member to pass between said photoemitter and said photodetector.

4. A system for establishing an absolute reference point according to claim 3, wherein said first reference point is produced by said detection means when said reciprocating member exits from between said photoemitter and said photodetector and said second reference point is produced by said detection means when said reciprocating member enters between said photoemitter and said photodetector or said first reference point is produced by said detection means when said reciprocation member enters between said photoemitter and said photodetector and said second reference point is produced by said detection means when said reciprocating member exits from between said photoemitter and said photodetector.

5. For use on a cyclically operating envelope inserter having a rotating shaft and a reciprocating member linked to the rotating shaft, a system for establishing an absolute reference point for timing a cycle of the envelope inserter, comprising:

a) a shaft encoder that reports a rotational angle value for the rotating shaft;

b) a detector comprising a photoemitter and a photodetector secured to the apparatus and positioned for the reciprocating member to pass between said photoemitter and said photodetector for establishing for the reciprocating member a first reference point as the reciprocating member moves in a first direction to a first limit and a second reference point as the reciprocating member moves in a second direction to a second limit, wherein if said reciprocating member is initially within said detector said first reference point is signaled by said detector when said reciprocating member is exiting said detector and said second reference point is signaled by said detector when said reciprocating member is entering said detector or if said reciprocating member is initially not within said detector said first reference point is signaled by said detector when said reciprocation member is entering said detector and said second reference point is signaled by said detector when said reciprocating member is exiting said detector and said first and said second reference points are each in terms of a rotational angle value reported from said shaft encoder; and c) a controller responsive to said detector and said shaft encoder and having programming that determines from said first and said second reference points a rotational angle value position for the absolute reference point, wherein said programming determination comprises:

i) establishing by means of said shaft encoder rotational angle values for said first and said second reference points and ii) averaging an absolute difference between said rotational angle values for said first and said second reference points and adding a resultant angle to whichever of said rotational angle values for said first and said second reference points is smaller to produce a rotational value for the absolute reference point.

6. A system for establishing an absolute reference point according to claim 5, wherein said controller means further comprises means for generating and issuing a pulse that indicates when the absolute reference point is reached.

7. A system for establishing an absolute reference point according to claim 5, wherein said first reference point is produced by said detection means when said reciprocating member exits from between said photoemitter and said photodetector thereby allowing light to pass between said photoemitter and said photodetector and said second reference point is produced by said detection means when said reciprocating member enters between said photoemitter and said photodetector thereby interrupting said light passing between said photoemitter and said photodetector or said first reference point is produced by said detection means when said reciprocation member enters between said photoemitter and said photodetector thereby interrupting said light passing between said photoemitter and said photodetector and said second reference point is produced by said detection means when said reciprocating member exits from between said photoemitter and said photodetector thereby allowing light to pass between said photoemitter and said photodetector.

8. For use on a cyclically operating apparatus having a rotating member and a reciprocating member linked to the rotating member, a method for establishing an absolute reference point, in terms of a rotational angle value, for timing a cycle of the apparatus, comprising the steps:

a) establishing for the reciprocating member via a detector a first signal at a first reference point as the reciprocating member moves in a first direction to a first limit and a second signal at a second reference point as the reciprocating member moves in a second direction to a second limit;

b) producing by use of a shaft encoder for ascertaining rotational angle values for the rotating member a first rotational angle value for said first signal at said first reference point and a second rotational angle value for said second signal at said second reference point;

c) determining from said first and said second rotational angle values for said first and said second reference points a rotational angle value position for the absolute reference point; and d) averaging an absolute difference between said first and said second rotational angle values for said first and said second reference points and adding a resultant angle to whichever of said first and said second rotational angle values for said first and said second reference points is smaller to produce a rotational value for the absolute reference point.

9. A method for establishing an absolute reference point according to claim 8, further comprising the step of generating a pulse that indicates when the determined absolute reference point is reached.

10. For use on a cyclically operating envelope inserter having a rotating shaft and a reciprocating member linked to the rotating shaft, a method for establishing an absolute reference point for timing a cycle of the envelope inserter, comprising the steps:

a) establishing for the reciprocating member via a detector comprising a photoemitter and a photodetector secured to the apparatus and positioned for the reciprocating member to pass between said photoemitter and said photodetector, a first reference point as the reciprocating member moves in a first direction to a first limit and a second reference point as the reciprocating member moves in a second direction to a second limit, wherein if said reciprocating member is initially within said detector said first reference point is signaled by said detector when said reciprocating member is exiting said detector and said second reference point is signaled by said detector when said reciprocating member is entering said detector or if said reciprocating member is initially not within said detector said first reference point is signaled by said detector when said reciprocation member is entering said detector and said second reference point is signaled by said detector when said reciprocating member is exiting said detector and;

b) producing by use of a shaft encoder for ascertaining rotational angle values for the rotating member a first rotational angle value for said first reference point and a second rotational angle value for said second reference points;

c) determining from said first and said second rotational angle values for said first and said second reference points a rotational position for the absolute reference point, wherein said determination comprises averaging an absolute difference between said first and said second rotational angle values for said first and said second reference points and adding a resultant angle to whichever of said first and said second rotational angle values for said first and said second reference points is smaller to produce a rotational value for the absolute reference point; and d) generating a pulse that indicates when the determined absolute reference point is reached.

11. For use on a cyclically operating apparatus, a system for establishing an absolute reference angle for timing a cycle of the apparatus, comprising:

a) a reciprocating member;

b) a rotatable shaft attached to said reciprocating member;

c) a shaft encoder coupled to said rotatable shaft to measure an angle of rotation of said reciprocating member;

d) a detector mounted so as to sense passing of said reciprocating member during one cycle of the apparatus; and e) a controller for monitoring said angle of rotation of said reciprocating member, establishing two reference angles during the movement of said reciprocating member during said one cycle of the apparatus, and calculating a bisector of said two reference angles which is the absolute reference angle.

* * * * *